US012152387B2

(12) United States Patent
Wiesener et al.

(10) Patent No.: US 12,152,387 B2
(45) Date of Patent: Nov. 26, 2024

(54) CEILING GRID SUPPORT BAR, AND CEILING SYSTEM

(71) Applicant: CertainTeed Ceilings Corporation, Malvern, PA (US)

(72) Inventors: Christopher Wiesener, Orangeville (CA); Aaron Davis, Lakewood, OH (US); Zachary Donahue, Malvern, PA (US)

(73) Assignee: CertainTeed Ceilings Corporation, Malvern, PA (US)

( * ) Notice: Subject to any disclaimer, the term of this patent is extended or adjusted under 35 U.S.C. 154(b) by 1 day.

(21) Appl. No.: 17/815,134

(22) Filed: Jul. 26, 2022

(65) Prior Publication Data

US 2023/0037173 A1 Feb. 2, 2023

Related U.S. Application Data

(60) Provisional application No. 63/203,642, filed on Jul. 27, 2021.

(51) Int. Cl.
*E04B 9/12* (2006.01)

(52) U.S. Cl.
CPC ..... *E04B 9/127* (2013.01)

(58) Field of Classification Search
CPC . E04B 9/127; E04B 9/34; E04B 9/245; E04B 9/067; E04B 9/18; E04B 9/225; E04B 9/10
See application file for complete search history.

(56) References Cited

U.S. PATENT DOCUMENTS 3,032,833 A * 5/1962 Stanley ..... E04B 9/12 52/506.07
3,627,364 A * 12/1971 Van Riet ..... E04B 9/127 403/241
3,640,042 A * 2/1972 Kidney ..... E04B 9/247 52/779
4,064,671 A * 12/1977 Sauer ..... E04B 9/16 52/669
4,114,327 A * 9/1978 Williams ..... F21V 21/04 52/39
4,364,215 A * 12/1982 Gailey ..... E04B 9/065 52/506.08

(Continued)

OTHER PUBLICATIONS

USG/CGC, "USG True(TM) Wood Grille," Brochure, 2020 copyright date.

(Continued)

*Primary Examiner* — Gisele D Ford
(74) *Attorney, Agent, or Firm* — McDonnell Boehnen Hulbert & Berghoff LLP

(57) ABSTRACT

The present disclosure relates generally to ceiling grids, for example, suitable for forming a suspended ceiling. The present disclosure relates more particularly to a support bar configured to extend across grid beams of a ceiling grid. The support bar includes a first hook configured to secure to a first grid beam of the ceiling grid and a second hook configured to secure to a second grid beam of the ceiling grid. A spanning member extends from the first hook to the second hook and is configured to support the weight of an element attached to the support bar.

13 Claims, 11 Drawing Sheets

(56) References Cited

U.S. PATENT DOCUMENTS

| | | | | | |
|---|---|---|---|---|---|
| 4,744,188 | A * | 5/1988 | Ahren | E04B 9/34 | 52/506.07 |
| 4,757,663 | A * | 7/1988 | Kuhr | E04B 9/16 | 52/664 |
| 5,045,985 | A | 9/1991 | Russo | | |
| 6,047,517 | A * | 4/2000 | Vrame | E04B 9/006 | 52/669 |
| 6,446,406 | B1 * | 9/2002 | Sauer | E04B 9/064 | 52/506.06 |
| 7,392,629 | B1 * | 7/2008 | Bankston | E04B 9/068 | 52/506.07 |
| 7,634,881 | B2 * | 12/2009 | Ahren | E04B 9/241 | 52/762 |
| 7,658,047 | B2 * | 2/2010 | Bankston | E04B 9/006 | 52/506.07 |
| 7,784,754 | B2 | 8/2010 | Nevers | | |
| 8,596,009 | B2 | 12/2013 | Baxter | | |
| 8,615,947 | B2 * | 12/2013 | Underkofler | E04B 9/18 | 248/323 |
| 8,745,947 | B2 * | 6/2014 | Jahn | E04B 9/28 | 52/777 |
| 8,955,272 | B1 * | 2/2015 | Underkofler | E04B 9/242 | 52/220.6 |
| 9,187,896 | B1 * | 11/2015 | Bergman | E04B 9/10 | |
| 2015/0033657 | A1 * | 2/2015 | Underkofler | E04B 9/242 | 52/506.07 |
| 2020/0217071 | A1 * | 7/2020 | Yeo | E04B 9/242 | |

OTHER PUBLICATIONS

Armstrong Ceiling & Wall Solutions, "Woodworks(TM) Grille System—Assembly and Installation Instructions," 2021 copyright date.
9Wood, "2100 Data Sheet," downloaded 2021.
9Wood, "8100 Data Sheet," downloaded 2021.
Asi, "Grille—Backered—Detail Book," dated 2018.
Asi, "Grille—Backered: Installation Instructions," dated 2018.

* cited by examiner

CEILING GRID SUPPORT BAR, AND CEILING SYSTEM

CROSS-REFERENCE TO RELATED APPLICATIONS

This application claims the benefit of priority of U.S. Provisional Application No. 63/203,642, filed Jul. 27, 2021, which is hereby incorporated herein by reference in its entirety.

BACKGROUND OF THE DISCLOSURE

1. Field of the Disclosure

The present disclosure relates generally to ceiling grids, for example, suitable for forming a suspended ceiling. The present disclosure relates more particularly to a support bar for a ceiling grid.

2. Technical Background

Suspension grids that hold up acoustic ceiling panels, lighting fixtures, or other tiles or panels, are effective for constructing an attractive and convenient ceiling. The suspension grid is typically formed by a plurality of grid beams that form a support structure for other components of the ceiling, such as the ceiling panels. The suspension ceiling allows the builder to provide a clean and uninterrupted boundary to the space below the ceiling while hiding infrastructure such as structural members, heating, ventilation and air conditioning (HVAC) components, wiring, and plumbing in a plenum space above the ceiling. Further, suspension ceilings provide the benefit of being modular. If any portion of the ceiling is damaged, that portion can be replaced without deconstructing the entire ceiling.

Ceiling grids typically have a relatively uniform construction, where the grid beams all have a similar configuration along their lengths, perhaps with differing features at the ends or along their lengths for attaching to other beams of the grid. This similarity in construction over the span of the ceiling grid can help make installation and design of the ceiling efficient. However, the uniformity of the ceiling grid may lead to difficulty in securing certain elements to the ceiling gird or in securing the elements in a particular way or orientation.

The present inventors have recognized that a ceiling system that allows for more flexibility in the attachment of accessories, tiles, ceiling equipment or other elements to the ceiling grid would be attractive to builders and designers.

SUMMARY OF THE DISCLOSURE

In one aspect, the present disclosure provides a support bar configured to extend across grid beams of a ceiling grid, the support bar comprising:

- a first hook configured to secure to a first grid beam of the ceiling grid;
- a second hook configured to secure to a second grid beam of the ceiling grid; and
- a spanning member extending from the first hook to the second hook and configured to support the weight of an element attached to the support bar.

In another aspect, the disclosure provides a ceiling system comprising:

- a ceiling grid including a plurality of grid beams comprising a first grid beam and a second grid beam that is parallel to the first grid beam; and
- a support bar according to the disclosure extending from the first grid beam to the second grid beam,
- wherein the first hook of the support bar is secured to the first grid member and the second hook of the support bar is secured to the second grid member.

In another aspect, the disclosure provides a ceiling system comprising:

- a ceiling grid including a plurality of grid beams comprising a first grid beam and a second grid beam that is parallel to the first grid beam;
- a support bar according to the disclosure extending from the first grid beam to the second grid beam, wherein the first hook of the support bar is secured to the first grid member and the second hook of the support bar is secured to the second grid member; and
- an access ceiling panel coupled to the spanning member of the support bar using a mechanical fastener.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

As described above, the present inventors have recognized that a ceiling system that allows for more flexibility in the attachment of accessories, tiles, ceiling equipment or other elements to the ceiling grid would be attractive to builders and designers.

Accordingly, one aspect of the disclosure is a support bar configured to extend across grid beams of a ceiling grid. The support bar includes a first hook configured to secure to a first grid beam of the ceiling grid and a second hook configured to secure to a second grid beam of the ceiling grid. A spanning member extends from the first hook to the second hook and is configured to support the weight of an element attached to the support bar.

Figure 1A:
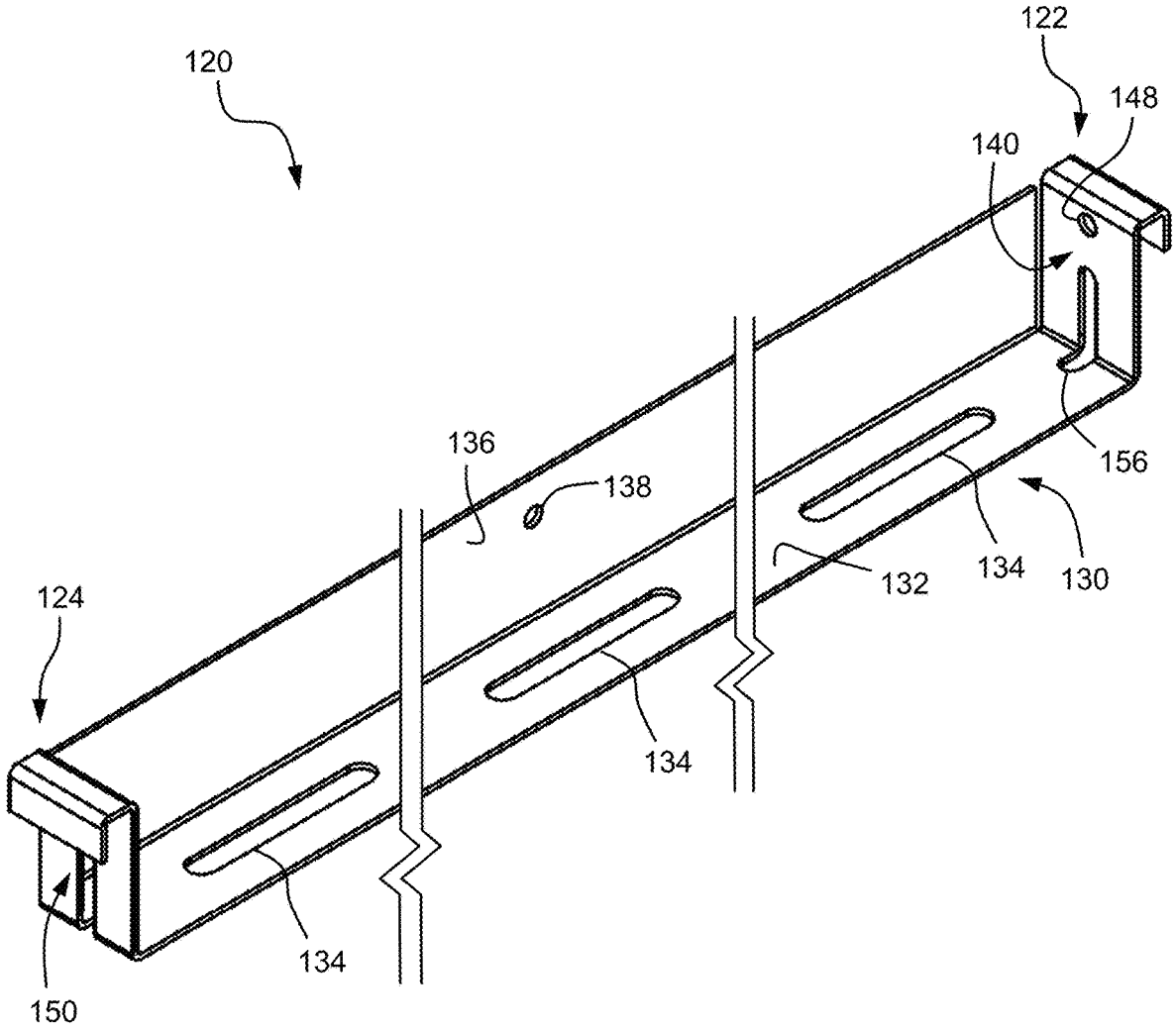
FIG. 1A is a schematic perspective view of a support bar according to an embodiment of the disclosure.

Such a support bar is shown in perspective view in FIG. 1A. Support bar 120 includes a spanning member 130 that extends between a first hook 140 and a second hook 150. The first hook 140 and second hook 150 are each configured to couple to grid members of a ceiling grid such that spanning member 130 extending therebetween can support the weight of an element attached to support bar 120.

Accordingly, in another aspect, the disclosure provides a ceiling system that includes a ceiling grid together with the support bar of the disclosure. The ceiling grid comprises a plurality of grid beams including a first grid beam and a second grid beam that is parallel to the first grid beam. The support bar extends from the first grid beam to the second grid beam and is configured to support the weight of an element attached thereto so as to secure the element with respect to the ceiling grid. The first hook of the support bar is secured to the first grid member and the second hook of the support bar is secured to the second grid member.

Figure 1B:
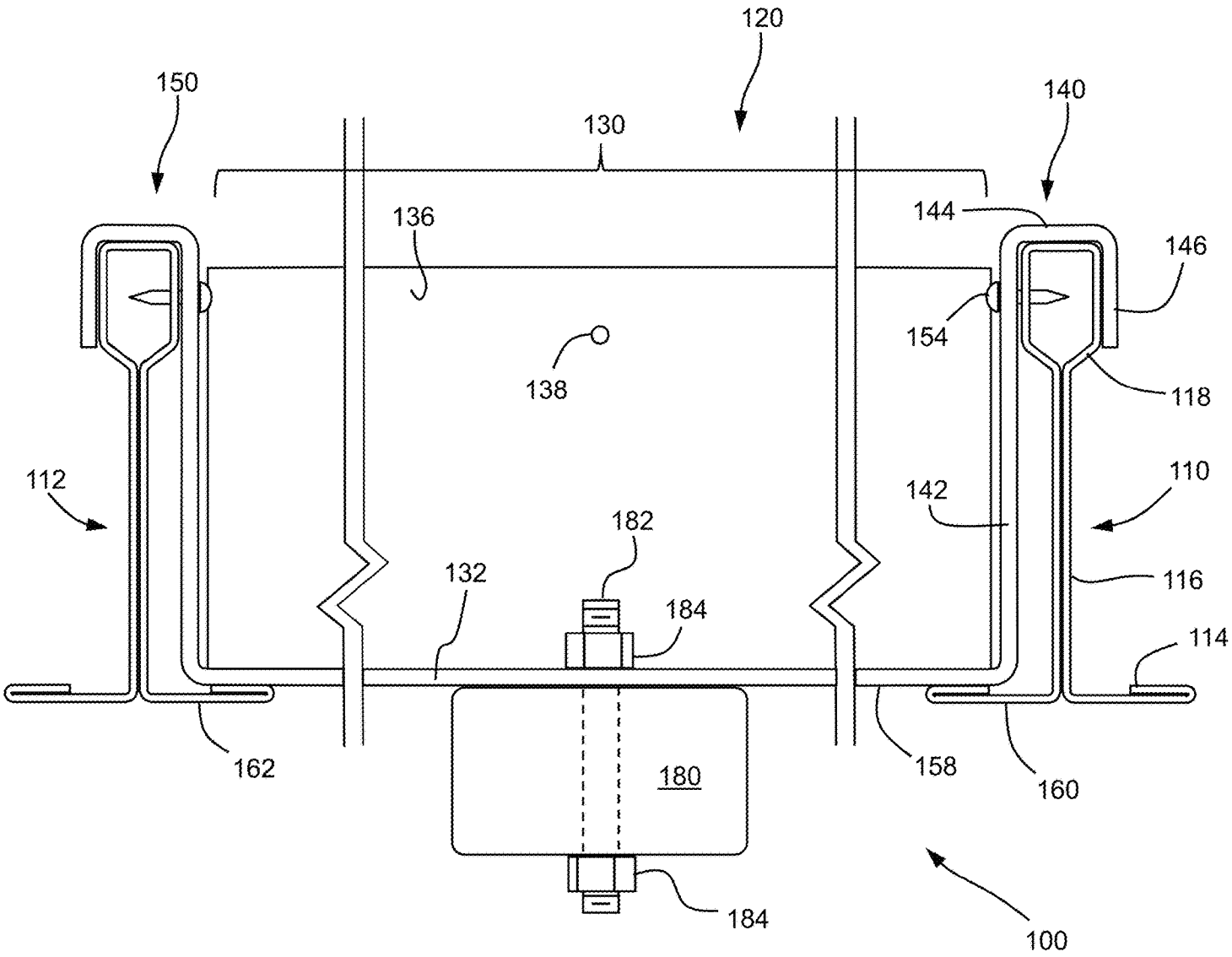
FIG. 1B is a schematic cross-sectional view of a ceiling system according to an embodiment of the disclosure including the support of FIG. 1A.

A side view of such a ceiling system is shown in FIG. 1B. Ceiling system 100 includes a ceiling grid that includes a first grid beam 110 and a second grid beam 112 that extend in parallel across the ceiling grid. Support bar 120 is attached to the ceiling grid with first hook 140 secured to first grid beam 110 and second hook 150 secured to second grid beam 112. Accordingly, spanning member 130 extends across the distance between first grid beam 110 and second grid beam 112 and supports the weight of an element 180 coupled thereto. In particular, element 180 is coupled to spanning member 130 of support bar 120 using a mechanical fastener in the form of a threaded bolt 182 and nuts 184 that hold element 180 on bolt 182. In other embodiments, the ceiling system uses a different type of mechanical fastener to secure an element to the support bar, such as a screw, pin, rivet, or another type of fastener.

In certain embodiments of the ceiling system as otherwise described herein, the grid beams are T-beams. For example, first grid beam 110 is in the form of a T-beam that includes a pair of laterally extending flanges 114 and a web 116 extending up from the flanges 114. Further, first grid beam 110 is formed from a bent metal sheet that loops at the top to form a bulb 118, which provides structural stability to first grid beam 110. In other embodiments, the grid beams may a have a different configuration, such as an extruded T-beam, with or without a bulb at the peak. Moreover, in some embodiments, the grid beams have a different shape that is not a T-beam, such as an I-beam or channel configuration.

In certain embodiments of the support bar as otherwise described herein, the first hook is disposed at a first end of the support bar and the second hook is disposed at a second end of the support bar. For example, first hook 140 is disposed at a first end 122 of support bar 120 while second hook 150 is disposed at a second end 124 of support bar 120, such that first hook 140 and second hook 150 define a length of support bar 120. In other embodiments, the support bar may extend beyond one or both hooks. For example, in some embodiments, the support bar includes a second spanning member that extends from the second hook to a third hook configured to couple to yet another grid beam. In such an embodiment, the second hook is not disposed at an end of the support bar and the length of the support bar is greater than the distance from the first hook to the second hook. Likewise, in some embodiments, the support bar includes a flange or coupling structure connected to the second hook and opposite the spanning member, such that support bar extends past the second hook and the second end of the support bar is past the second hook. Likewise, in some embodiments, such an extension is provided on both ends of the support bar adjacent to both the first hook and the second hook. In such an embodiment, neither the first hook nor the second hook is at the end of the support bar.

In certain embodiments of the support bar as otherwise described herein, the spanning member includes a base plate. For example, spanning member 130 of support bar 120 includes a horizontal base plate 132 that extends from first hook 140 to second hook 150 providing a flat support structure that extends along the length of support bar 120. In other embodiments, the base plate extends over only a portion of the length of spanning member. For example, in some embodiments, the spanning member may be formed by spaced sections of a base plate combined with another structure that bridges the sections of the base plate. For example, in some embodiments, sections of a base plate may be bridged by a web or channel structure that holds the base plate sections together. Further, in other embodiments, the spanning member has another configuration. For example, in some embodiments, the spanning member is formed by a rounded tube or a vertical strip.

In certain embodiments of the support bar as otherwise described herein, the first hook is configured as a bent plate that extends from the base plate of the spanning member. For example, in support bar 120, as shown in FIGS. 1A and 1B, both first hook 140 and second hook 150 are formed by an extension of the material that forms base plate 132 of spanning member 130. In other words, base plate 132, first hook 140, and second hook 150 are formed by a single strip of material that is bent at the ends to form the first hook 140 and second hook 150.

Figure 2:
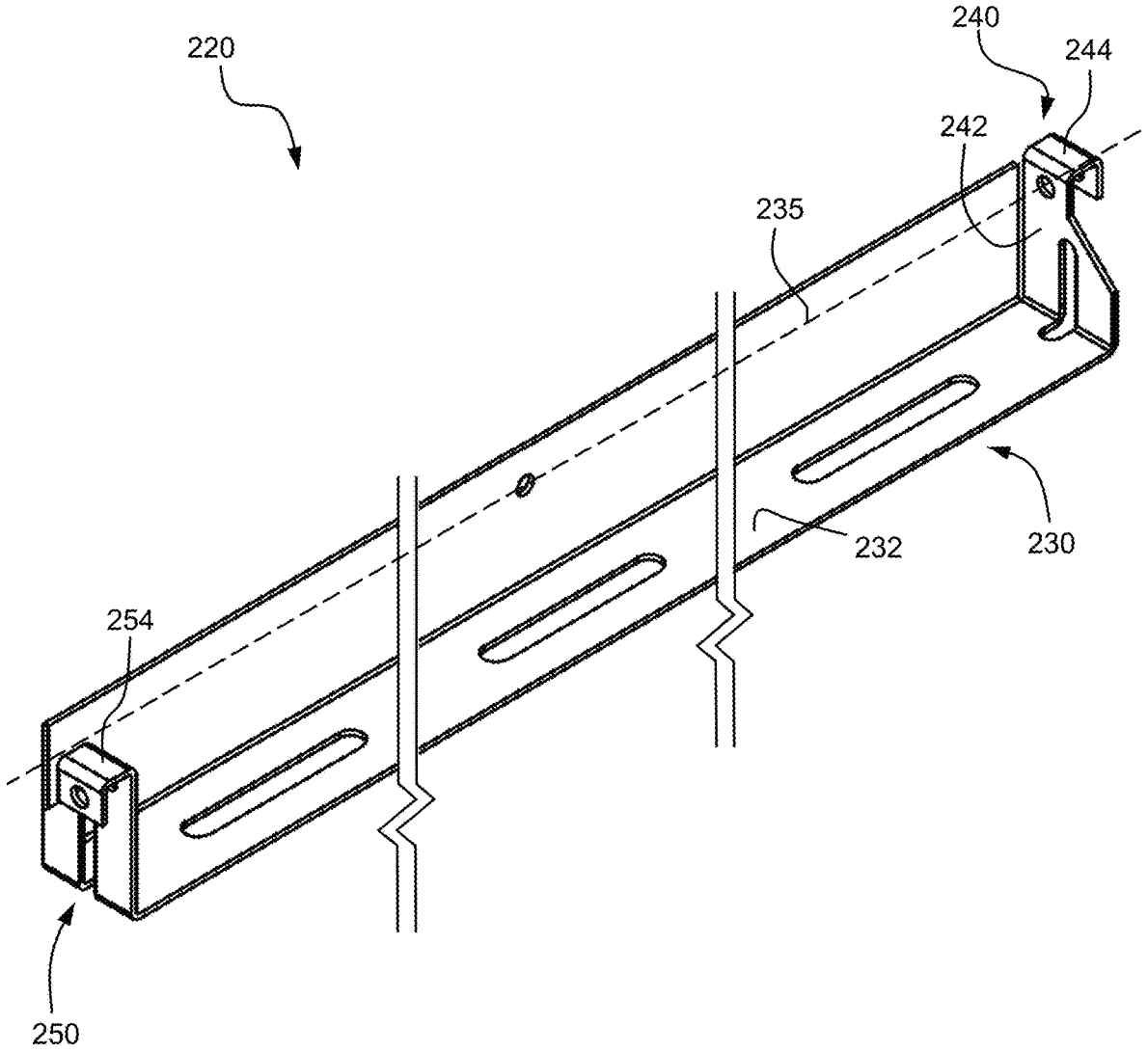
FIG. 2 is a schematic perspective view of a support bar according to another embodiment of the disclosure.

In certain embodiments of the support bar as otherwise described herein, the width of the first hook is the same as the width of the base plate. For example, because first hook 140 and second hook 150 are formed as an extension of the material that forms base plate 132, all three of base plate 132, first hook 140 and second hook 150 have the same width. In other embodiments, the first hook and the second hook have different widths than the base plate. For example, in some embodiments, the first hook and the second hook are wider than the entire spanning member, to have added stability of the connection between the support bar and grid beams. On the other hand, in some embodiments, the base plate of the spanning member is wider than the first hook and second hook, so as to reduce the amount of space on the grid beams that is occupied by the hooks. Such an embodiment is shown in FIG. 2, as described in more detail below. Further, in some embodiments, the first hook, second hook, and base plate all have different widths based on the use of the support bar.

In certain embodiments of the support bar as otherwise described herein, the first hook includes a leg projecting upward from the base plate and a bend configured to extend over the first grid beam. For example, in certain embodiments of the ceiling system as otherwise described herein, the first hook is coupled to the first grid beam by extending upward from the base plate along a leg and over the first grid beam with a bend of the first hook. For example, as shown in FIG. 1B, first hook 140 of support bar 120 includes a leg 142 that extends upward from base plate 132 of spanning member 130 and a bend 144 that extends over bulb 118 at the top of first grid beam 110. Accordingly, bend 144 of first hook 140 rests on first grid beam 110 and the weight of element 180 is supported by the ceiling grid via spanning member 130 and first hook 140 of support bar 120.

In certain embodiments of the support bar as otherwise described herein, a width of the bend of the first hook is no more than half the width of the base plate. Accordingly, the bend occupies a smaller area of the top of the grid beam than the width of the base plate, thereby allowing the remainder of the grid beam to be utilized for other purposes. For example, such an embodiment is shown in FIG. 2. Support bar 220 includes a first hook 240 and a second hook 250 at opposite ends of a spanning member 230. First hook 240 includes a leg 242 that extends upward from a base plate 232 of spanning member 230 to a bend 244 configured to rest on a grid beam. Bend 244 is less than half the width of base plate 232. Accordingly, the width of the mounting area provided by spanning member 230 is twice the width of the first grid beam that is occupied by first hook 240 when coupled to a ceiling grid.

In certain embodiments of the support bar as otherwise described herein, the bend of the first hook is positioned entirely on a first side of a centerline that extends along a length of the base plate. For example, support bar 220 includes a centerline 235 that runs along the length of spanning member 230 and is centered with respect to the width of base plate 232. Bend 244 of first hook 240 is narrower than base plate 232 and is positioned entirely on one side of centerline 235. While the bend 244 of first hook 240 is isolated to one side of centerline 235 as a result of being less than half the width of base plate 232, in other embodiments the bend is wider than half the width of the base plate, but is offset from the base plate so as to be positioned on one side of the centerline. In other embodiments, such as in FIG. 1, the bend extends over the centerline.

In certain embodiments of the support bar as otherwise described herein, the second hook includes a leg projecting upward from the base plate and a bend configured to extend over the second grid beam, and where the bend of the second hook is positioned entirely on a second side of the centerline. For example, in support bar 220, second hook 250 includes a bend 254 that is positioned on a second side of centerline 235. This configuration allows two support bars with the same configuration to be positioned end-to-end in a line without interfering with one another. For example, two support bars having the configuration of support bar 220 can be placed in a line across three grid beams with the centerline 235 of both spanning members 230 being aligned. The hooks of the two support bars that are attached to the middle grid beam are able to avoid interfering with one another because each of these hooks falls on opposing sides of the aligned centerlines.

In certain embodiments of the support bar as otherwise described herein, the first hook includes a downward extension projecting downward from the bend such that the hook is configured to surround a portion of the first grid beam. For example, in certain embodiments of the ceiling system as otherwise described herein, a downward extension that projects downward from the bend allows the hook to surround a portion of the first grid beam. For example, as shown in FIG. 1B, downward extension 146 extends from bend 144 of hook 140 so as to be positioned on the side of bulb 118 that is opposite leg 142. Accordingly, bulb 118 is surrounded on three sides by leg 142, bend 144 and downward extension 146. This configuration can help secure support bar 120 on first grid beam 110. In other embodiments, the first hook is configured without a downward extension. For example, in some embodiments, the first hook includes only a bend that rests on top of the first grid beam. In such a case, movement of the support bar away from the first grid beam may be hindered by the engagement of the second hook with the second grid beam. In other words, in embodiments without the downward extension of the hook, the support bar may be secured in place by the positioning of the first and second hooks relative to the first and second grid beams. For example, where the distance between the first and second hooks is fixed and substantially the same as the distance between the grid beams, support by the second grid beam will maintain the first hook on the first grid beam and support by the first grid beam will maintain the second hook on the second grid beam.

Figure 3:
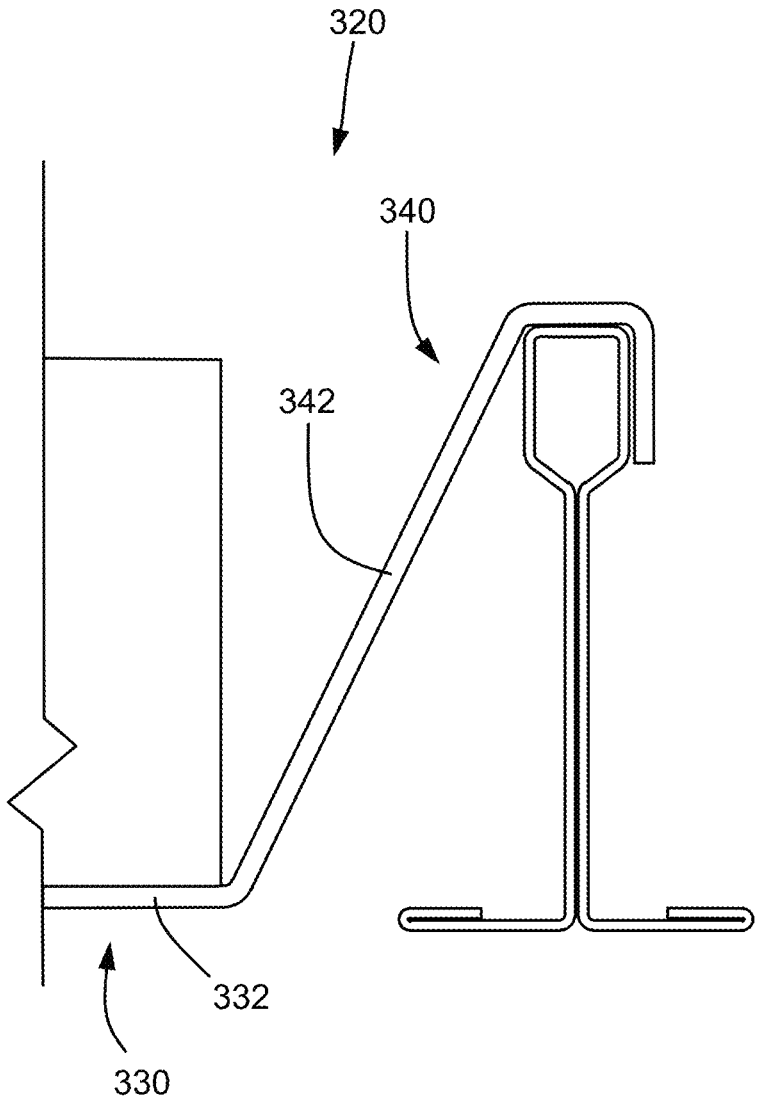
FIG. 3 is a schematic cross-sectional view of a ceiling system according to another embodiment of the disclosure.

In certain embodiments of the support bar as otherwise described herein, the leg of the first hook extends substantially vertically from the base plate. For example, leg 142 of first hook 140 is positioned perpendicular to base plate 132 such that it extends vertically upward toward bend 144. The phrase substantially vertically, as used herein, means within 5 degrees of a vertical arrangement. In some embodiments, the leg of the first hook is within 2 degrees of vertical. On the other hand, in other embodiments, the leg of the first hook extends at an angle from the base plate to the bend. A portion of an embodiment of a support bar including a first hook that has such a configuration is shown in FIG. 3. Support bar 320 includes a spanning member 330 that has a base plate 332. A first hook 340 is disposed at an end of spanning member 330 and includes a first leg 342 that extends upward from base plate 332 at an obtuse angle $\alpha$. In some embodiments, the angle between the base plate and the first leg is in a range from 120° and 150°. In other embodiments, the angle is less than 120°. For example, in some embodiments, the angle is closer to 90°, such as in support bar 120, shown in FIGS. 1A and 1B. Further still, in some embodiments, the angle between the base plate and the first leg is acute. For example, in some embodiments, the base plate extends slightly under the bulb of the grid beam, such that first leg projects back slightly over the base plate toward the bulb of the grid beam.

In certain embodiments of the support bar as otherwise described herein, the first hook includes an aperture configured to receive a fastener for securing the first hook to the first grid beam. For example, in certain embodiments of the ceiling system, the first hook of the support bar is connected to the first grid beam using a fastener. In some embodiments, the fastener is a screw or bolt. In some embodiments, the fastener is driven into a wall of the first grid beam, i.e., without any pre-existing aperture in the first grid beam. In other embodiments, the first grid beam includes an aperture to receive the fastener. Support bar 120, as shown in FIG. 1A, includes such an aperture 148 at the top of leg 142 of first hook 140. As shown in FIG. 1B, a fastener 154 may extend through the aperture and into the bulb 118 of first grid beam 110 to couple support bar 120 to first grid beam 110. In other embodiments, the aperture is positioned in another location on the first hook. For example, in some embodiments, the aperture is located in the bend of the first hook. In other embodiments, the aperture is located in a downward extension of the first hook. Further, in some embodiments, the first hook includes more than one aperture configured to receive a mechanical fastener for securing the first hook to the first grid beam.

In the embodiment shown in FIGS. 1A and 1B, support bar 120 includes a first hook 140 and a second hook 150 that have the same configuration. In other embodiments, the first and second hooks have different configurations. For example, in some embodiments, the first and second hooks are configured to engage grid beams of different shapes and have different configurations to accommodate those shapes. Further still, in some embodiments, the support bar includes a first hook to engage a grid beam and a second hook to engage another component of a ceiling structure.

In certain embodiments of the support bar as otherwise described herein, the base plate is configured as a flange and the spanning member further comprises a web extending upward from the base plate. For example, spanning member 130 of support bar 120 is configured as an L-shaped beam including base plate 132 and a web 136 extending upward from base plate 132. The web can add strength to the spanning member 130 to avoid buckling or bending. In other embodiments the spanning member has another configuration that includes a web. For example, in some embodiments, the web extends up from the center of the base plate, such as an inverted T-shaped beam. Still, in other embodiments, the spanning member has another shape, such as another common structural beam configuration, for example and I-beam, C-channel, or tubing. Further, in some embodiments, the spanning member does not include a web. For example, in some embodiments, the spanning member is formed entirely by a base plate.

In certain embodiments of the support bar as otherwise described herein, the web includes an aperture. For example, web 136 of support bar 120 includes an aperture 138 extending through the web. Such an aperture may be useful for securing an article to the support bar. For example, in some embodiments, an aperture in the web of the spanning member may be used to secure a wire for hanging the support bar from a ceiling structure. Such a wire, placed along the length of the spanning member, can bear some of the load held by the support bar. In other embodiments, the web may be constructed of a framework, or set of structural elements connected at discrete points, that serve to provide strength for the purpose of supporting the spanning member and anticipated loads. Thus, in some embodiments, the web has a majority solid surface and in other embodiments it does not. Further, in some embodiments, the web and the spanning member may have similar or mirror image apertures along the lengths thereof.

In certain embodiments of the support bar as otherwise described herein, the spanning member includes a plurality of apertures along the length thereof. For example, spanning member 130 of support bar 120 has a plurality of apertures 134 along its length. The apertures may be used for securing an element to the support bar, such that the element is supported by the ceiling grid via the support bar. The element secured to the support bar can take a variety of different forms, such as a ceiling panel, as described in more detail below, a light, ventilation equipment, electrical or network equipment, or any other element that is beneficially supported by or integrated into a ceiling.

In certain embodiments of the ceiling system, the element is secured to the support bar using a mechanical fastener that extends through one of the apertures. For example, FIG. 1B show an element 180 that is secured to support bar 120 using a threaded bolt 182 that passes through element 180 and one of the apertures 134 in spanning member 130. A pair of nuts 184 secures the element 180 and support bar 120 to the bolt 182. Element 180 is shown as a plank that may be part of a larger structure.

Figure 4:
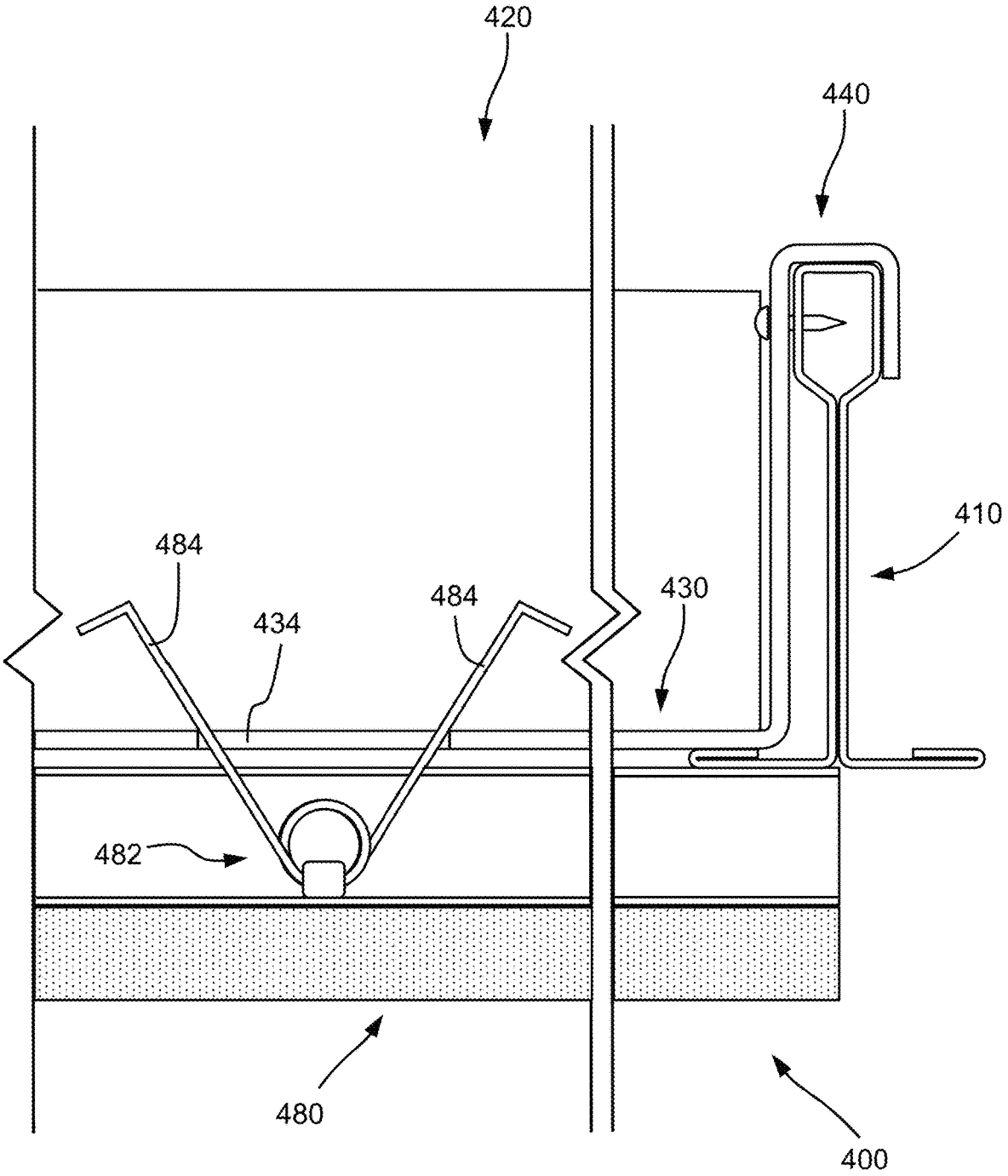
FIG. 4 is a schematic cross-sectional view of a ceiling system according to another embodiment of the disclosure.

In certain embodiments of the ceiling system, the element is secured to the support bar using a torsion spring that extends through one of the apertures. A portion of an embodiment of a ceiling system including an element secured to a support bar using a torsion spring is shown in FIG. 4. Ceiling system 400 includes a support bar 420 including a spanning member 430 and a first hook 440 secured to a first grid beam 410. An element 480 in the form of a ceiling panel is secured to support bar 420 using a torsion spring 482 that is attached to ceiling panel 480. To install torsion spring 482, the two legs 484 of torsion spring 482 are pressed toward one another, and the legs 484 are inserted through aperture 434 of support bar 420. The legs 484 are then released, and the coil of torsion spring 482 urges the legs outward, which prevents the torsion spring 482 from falling through aperture 434, thereby holding ceiling panel 480 securely against support bar 420.

In other embodiments, the element is secured to the support bar using a clip that engages the support bar. For example, in some embodiments, a clip is secured to the ceiling element and the clip extends through an aperture in the spanning member, or around one or more edges of the base plate to hold the element to the support bar.

In certain embodiments of the support bar as otherwise described herein, the apertures in the spanning member are slots that extend in the length direction of the spanning member. For example, in spanning member 132 the apertures 134 are configured as a line of slots that extend along the length direction of support bar 120. Accordingly, the position of any element secured to support bar 120 can be adjusted along its length, and thus adjusted with respect to the ceiling grid. In some embodiments, the apertures are configured as a single line of slots, while in other embodiments, the apertures are configured as two or more rows of slots. Further, while the apertures in spanning member 132 are aligned with the length direction of the support bar, in other embodiments, the apertures are configured as slots that are perpendicular to the length of the support bar. Further, in other embodiments, the apertures are configured as slots that are disposed at an angle to the length of the support bar. On the other hand, in some embodiments, the apertures are not slots. For example, in some embodiments, the apertures are through-holes. Further still, in some embodiments, the apertures are a combination of slots and holes.

In some embodiments, the element is secured to the support bar using more than one mechanical fastener. For example, in some embodiments, a plurality of mechanical fasteners extend through the spanning element to connect the element to the support bar. In some embodiments, each of the fasteners extends through a respective aperture in the spanning member. In other embodiments, an aperture in the spanning element may have more than one mechanical fastener extend therethrough.

In certain embodiments of the support bar as otherwise described herein, the support bar includes an aperture that extends from the spanning member into the hook. For example, support bar 120 includes an end aperture 156 that extends from the base plate 132 into the leg 142 of hook first hook 140. The end aperture 156 can be used to secure items to the base plate 132 of support bar 120 or to the first hook 140, providing flexibility for the use of support bar 120.

In certain embodiments of the support bar as otherwise described herein, the height of the first hook is substantially the same as the height of the first grid beam. For example, in some embodiments of the ceiling system, the height of the first hook and the height of the first grid beam are substantially the same. The description of the first grid beam and first hook having substantially the same height refers to a difference in height of less than ½ inch, e.g., less than ¼ inch, e.g., less than ⅛ inch. Further, in some embodiments, the height of the first hook is the same as the height of the second hook. As a result of the height of the first hook and the height of the first grid beam being substantially the same, a lower surface of the spanning member is substantially aligned with a surface defined by the ceiling grid. For example, as shown in FIG. 1B, the lower surface 158 of base plate 132 of support bar 120 is substantially aligned with the lower surface 160 of first grid beam 110 and the lower surface 162 of second grid beam 112, with the difference in height being limited to the thickness of the grid beam flanges. Accordingly, support bar 120 can form part of a substantially uniform ceiling surface that is defined by the ceiling grid. This allows the support bar to be used with the ceiling grid to form a ceiling having a consistent height.

In certain embodiments of the ceiling system as otherwise described herein, a first end of the spanning member is supported by the first grid beam and a second end of the spanning member is supported by the second grid beam. For example, in some embodiments, the hooks of the support bar are supported by the tops of the grid beams while the spanning member is supported by another portion grid beams. For example, in ceiling system 100 shown in FIG. 1B, the spanning member 130 of support bar 120 rests on the flanges 114 of the first and second grid beams 110, 112. Accordingly, the support bar may be redundantly supported by the grid beams in two places. Further, in some embodiments, the weight of the support bar is held entirely by the bracing of the spanning member on the grid beams, while the hooks primarily function to hold the support bar in place. In other embodiments, the hooks bear the weight of the support bar and any loads applied thereto.

Figure 5:
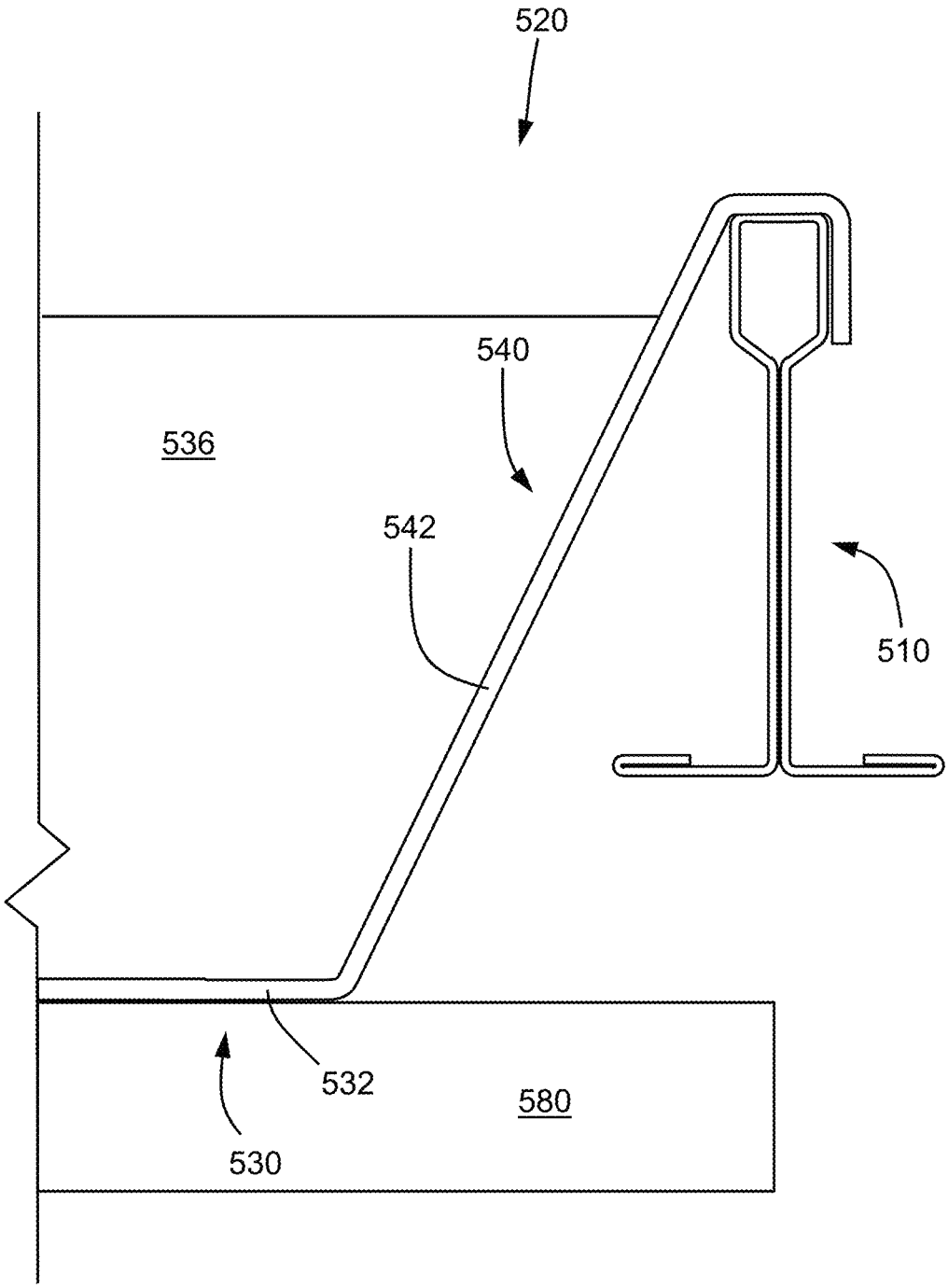
FIG. 5 is a schematic cross-sectional view of a ceiling system according to still another embodiment of the disclosure.

On the other hand, in some embodiments, a height of the first hook is configured to be greater than a height of the first grid beam. For example, in some embodiment of the ceiling system, the height of the first hook is greater than the height of the ceiling. A portion of an embodiment of a support bar including a first hook that has a greater height than the corresponding first grid member is shown in FIG. 5. Support bar 520 includes a spanning member 530 that has a base plate 532 and web 536 extending up from base plate 532. A first hook 540 is disposed at an end of spanning member 530 and includes a first leg 542 that extends upward from base plate 532. At the top of leg 542, first hook 540 is secured to first grid beam 510. The height of first hook 540 is greater than the height of first grid beam 510, such that the base plate 532 of spanning member 530 sits below the lower end of first grid beam 510. Accordingly, an element 580, such as a ceiling panel, attached under support bar 520 sits at a distance below first grid beam 510. This distance allows the ceiling element 580 and the support bar 520 to be raised and moved without the ceiling element 580 interfering with the grid beam 510.

The angle of first hook 540 and the distance provided by the extended height of first hook 540 can allow the support bar 520 and ceiling panel 580 to be angled into place on the grid beams from below the ceiling grid. For example, with the ceiling panel 580 secured to support bar 520, this assembly can be lifted so that the first grid beam 510 is placed between first leg 540 and ceiling panel 580. Support bar 520 and ceiling panel 580 can then be shifted toward first grid beam 510 so that the hook at the opposite end of support bar 520 can pass a corresponding grid beam of the ceiling grid. Support bar 520 and ceiling grid 580 may then be shifted back and centered so that both ends of the support bar 520 can be secured over the ceiling grid.

Further, in some embodiments, the height of the support bar is substantially equal to or less than the height of the grid beams. For example, in some embodiments, the support bar provides support to an element that is not held below the ceiling grid. In such a case, the height of the hooks may be smaller than height of the grid beams.

In certain embodiments of the support bar as otherwise described herein, the web of the spanning member is attached to the first hook. For example, in support bar 520, the web 536 extends outward at an angle to meet the leg 542 of first hook 540 where it is attached to the first hook 542. In other embodiments, the web is not attached to the hook. For example, as shown in FIG. 1, in support bar 120, web 136 is not attached to first hook 140.

In certain embodiments of the support bar as otherwise described herein, the support bar is formed from a cut and bent metal strip. The term metal strip, as used herein, is not limited to any particular thickness and may include materials conventionally referred to as sheet metal, metal foil, or metal plate. Forming the support bar from a metal strip can produce a support bar with high strength and low weight in a cost-effective manner. In other embodiments, the support bar is cast or extruded. Further, in some embodiments, the support bar is formed of another material. For example, in some embodiments, the support bar is formed of a plastic material or a wood material.

In certain embodiments of the support bar as otherwise described herein, a length of the support bar from the first hook to the second hook is about 12 inches, or about 24 inches, or about 48 inches. For example, in some embodiments, the support bar is configured to attach to a ceiling grid having grid beams spaced at about 12 inches, about 24 inches, or about 48 inches. The term about, as used herein, refers to lengths that are within 10% of the described length. For example, a support bar with a length between the first hook and second hook of 600 mm is about 24 inches. In other embodiments, the support bar has another length. For example, in some embodiments, the support bar has a length between 12 inches and 24 inches, or between 24 inches and 48 inches. Further, in some embodiments, the support bar has a length that is greater than 48 inches, such as 60 inches.

In certain embodiments of the support bar as otherwise described herein, a width of the support bar is at least 1 inch, e.g., at least 1.5 inches, e.g., at least 2 inches. Likewise, in certain embodiments of the support bar as otherwise described herein, a width of the support bar is no more than 8 inches, e.g., no more than 6 inches, e.g., no more than 4 inches. For example, in some embodiments, the support bar has a width in a range from 1 inch to 8 inches, e.g., from 1.5 inches to 6 inches, e.g., from 2 inches to 4 inches. Larger or smaller widths of the support bar are also possible.

In another aspect, the disclosure provides a ceiling system that includes a ceiling grid, a support bar according to the disclosure, and an access ceiling panel. The ceiling grid comprises a plurality of grid beams including a first grid beam and a second grid beam that is parallel to the first grid beam. The support bar extends from the first grid beam to the second grid beam and a first hook of the support bar is secured to the first grid member while a second hook of the support bar is secured to the second grid member. An access ceiling panel is coupled to the spanning member of the support bar using a mechanical fastener.

Figure 6:
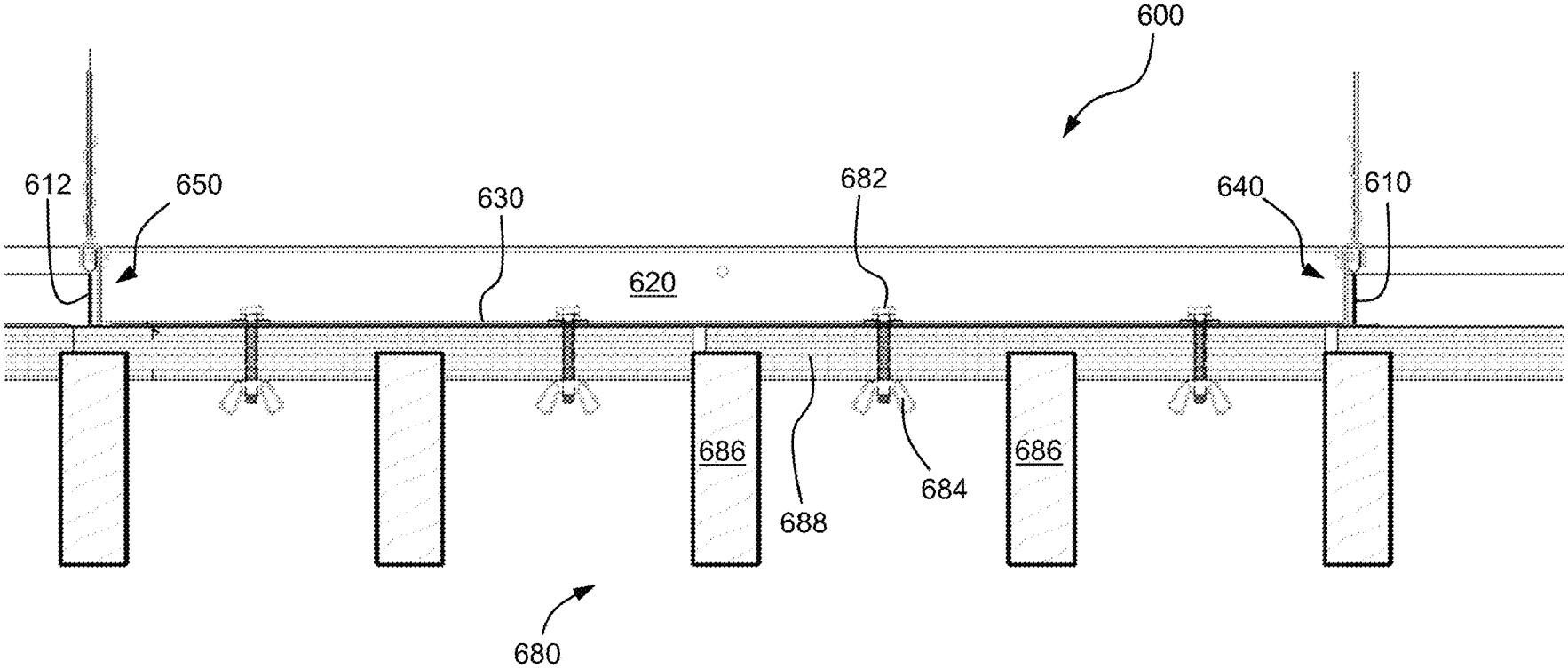
FIG. 6 is a schematic cross-sectional view of a ceiling system according to another embodiment of the disclosure.
Figure 7:
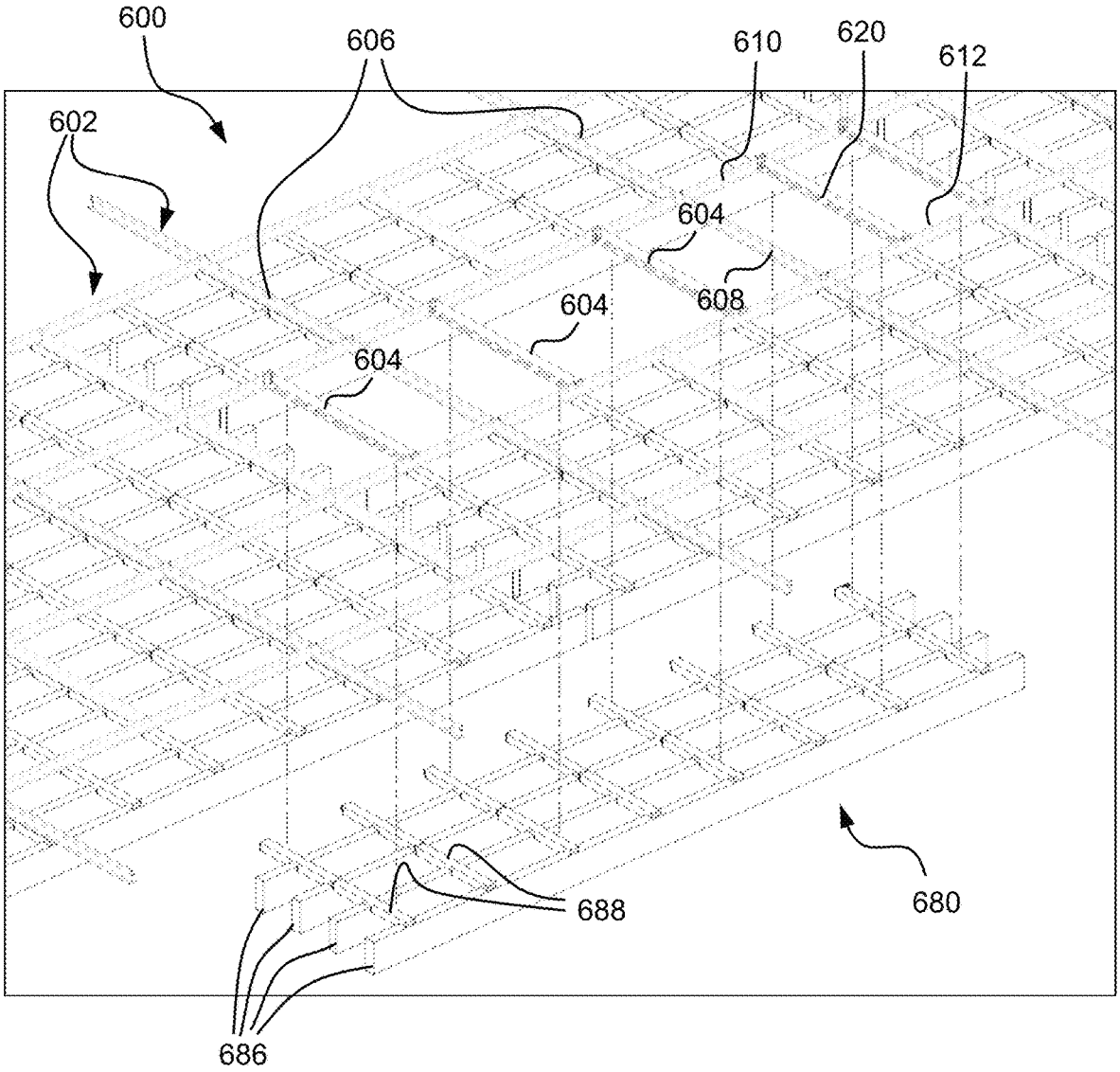
FIG. 7 is a schematic perspective view of the ceiling system of FIG. 6.

Such a ceiling system is shown in FIGS. 6 and 7. FIG. 6 shows a schematic cross-sectional view of a portion of a ceiling system 600, while FIG. 7 shows a schematic perspective view of a portion of ceiling system 600 with the access ceiling panel 680 removed from the ceiling grid 602.

As shown in FIG. 7, ceiling system 600 includes a ceiling grid 602 including a plurality of grid beams, several support bars, including a first support bar 620, and an access ceiling panel 680. The ceiling grid includes a first grid beam 610 and a second grid beam 612 with each of the support bars, including first support bar 620, extending therebetween. Each of the ceiling panels in ceiling system 600 is in the form of a grille. For example, access ceiling panel 680 includes a plurality of blades 686 attached to backers 688 that run across panel 680 perpendicular to blades 686.

FIG. 6 shows the connection between access ceiling panel 680, first support bar 620 and ceiling grid 602. First support bar 620 is attached to the ceiling grid with first hook 640 secured to first grid beam 610 and second hook 650 secured to second grid beam 612. Accordingly, spanning member 630 extends across the distance between first grid beam 610 and second grid beam 612 and supports the weight of access ceiling panel 680, which is attached to spanning member 630. For example, FIG. 6 illustrates one of the backers 688 attached to first support bar 620 using a mechanical fastener in the form of a threaded bolt 682 and wing nuts 684 that removably holds access ceiling panel 680 on bolt 682.

The use of mechanical fasteners to hold the access ceiling panel to the ceiling grid provides a positive attachment of the access ceiling panel to the grid. This differs from typical access panels, which may simply rest on the ceiling grid. Moreover, the use of mechanical fasteners that extend through apertures in the support bar, such as the shown bolt, allows the access ceiling panel to be removed and reinstalled repeatedly without damaging the panel, the ceiling grid, or the support bar.

In certain embodiments of the ceiling system as otherwise described herein, the plurality of grid beams of the ceiling grid includes transverse beams that extend from the first gird beam to the second grid beam so as to form openings in the ceiling grid. For example, as shown in FIG. 7 ceiling grid 602 includes a plurality of beams including first grid beam 610 and second grid beam 612 that extend in one direction and a plurality of transverse beams 606 that run perpendicular to the other beams. Accordingly, the grid forms a plurality of openings between the grid beams. In some embodiments, one or both of the first and second grid beams is a main beam that is structurally supported by the surrounding structure and that, in turn, supports other beams of the grid, while the transverse beams are cross beams that extend from one beam of the grid to another. In other embodiments one or more of the transverse beams is a main beam and the first and second grid beams are cross beams. Further, in some embodiments, none of the beams adjacent to the access ceiling panel is a main beam.

In certain embodiments of the ceiling system as otherwise described herein, the access ceiling panel is sized to fit in a single opening of the ceiling grid. For example, in some embodiments, the access ceiling panel is configured to extend no further than from the first grid beam to the second and across a pair of neighboring transverse beams. In other embodiments of the ceiling system as otherwise described herein, the access ceiling panel extends over a transverse beam so as to overlap more than one opening. For example, in ceiling system 600, access ceiling panel 680 extends across two openings in the ceiling grid 602, extending over central transverse beam 608, as shown in FIG. 7.

In certain embodiments of the ceiling system as otherwise described herein, the system further includes an additional support bar extending form the first grid beam to the second grid beam, wherein the access ceiling panel is coupled to the additional support bar. For example, as shown in FIG. 7, ceiling system 600 includes first support bar 620 and a plurality of additional support bars 604 extending from first grid beam 610 to second grid beam 612. Each of the additional support bars 604 is also configured to hold access ceiling panel 680. While ceiling system 600 uses multiple support bars to hold access ceiling panel 680, in other embodiments, the access ceiling panel is supported by a single support bar.

In certain embodiments of the ceiling system as otherwise described herein, the access ceiling panel is not mechanically fastened to the grid beams of the ceiling grid. For example, in ceiling system 600, the access ceiling panel 680 is mechanically fastened to the support bars 620, but not fastened directly to the grid. In other embodiments, the access ceiling panel is fastened to the grid with certain releasable fasteners, such as clips, but not attached to the grid beams with any threaded fasteners. Accordingly, the access ceiling panel can be repeatedly installed and removed from the ceiling system without the need to remove threaded components from the beams of the ceiling grid.

In certain embodiments of the ceiling system as otherwise described herein, the system further includes a fixed ceiling panel coupled to the grid beams. For example, in some embodiments, other ceiling panels in the ceiling system are fixedly attached to the grid members, such as by using screws. In other words, in some embodiments, one or more access ceiling panels are attached to support bars in the ceiling system, while the other ceiling panels are attached directly to the grid beams of the ceiling grid. In other embodiments, all of the ceiling panels are attached to support bars and act as ceiling access panels, and none of the panels are attached directly to the ceiling grid.

Figure 8:
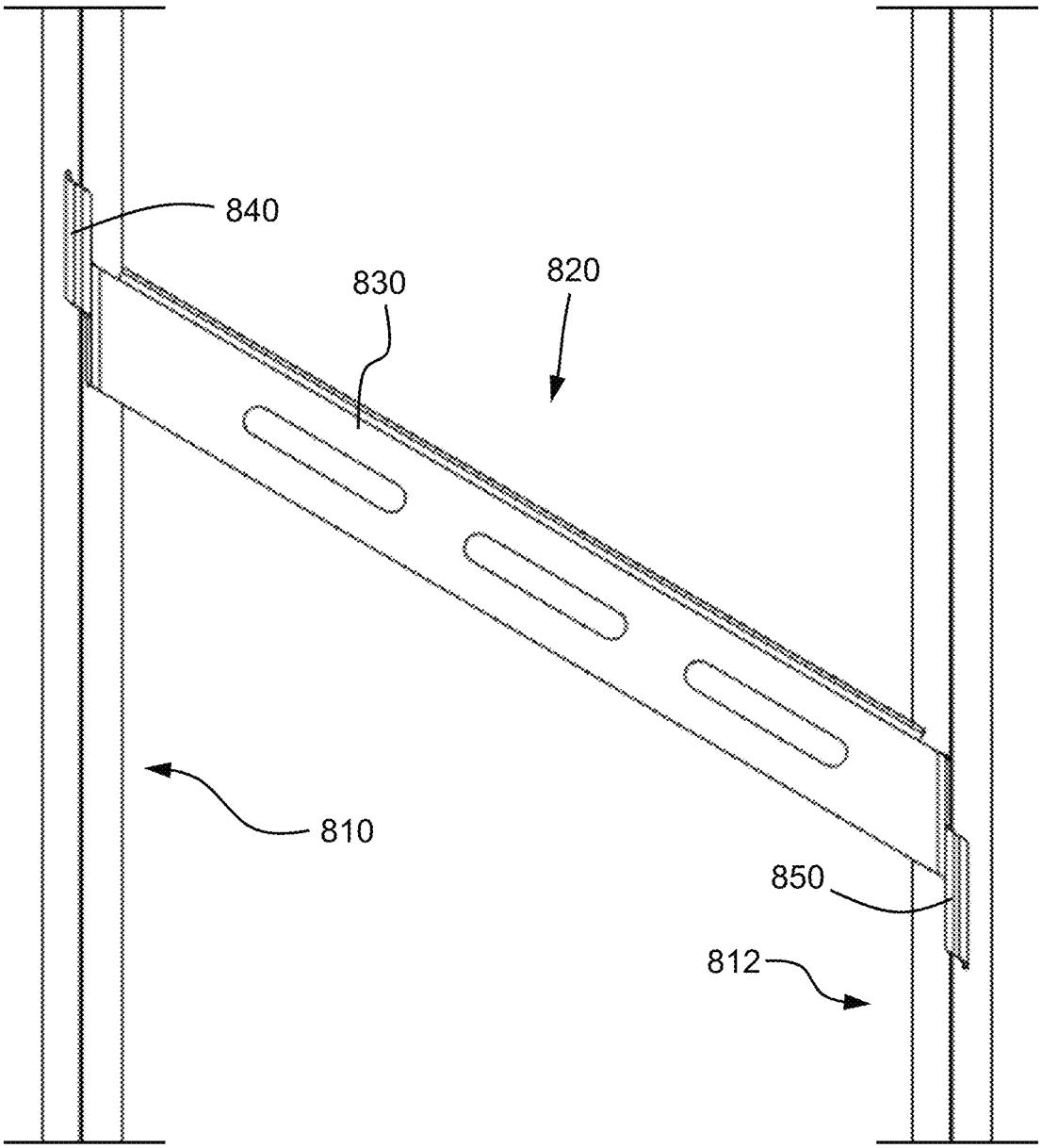
FIG. 8 is a schematic top view of ceiling system according to another embodiment of the disclosure.

While the embodiments of the support bar shown in FIGS. 1-7 are configured to extend between parallel grid beams at an angle that is perpendicular to the grid beams, in other embodiments, the support bar may be configured to be disposed at an angle to the grid beams. For example, such an embodiment is shown in FIG. 8. Support bar 820 includes a spanning member 830 that extends between a first hook 840 and a second hook 850. The first hook 840 and second hook 850 are configured to couple to a first grid beam 810 and second grid beam 812 that run parallel to one another. However, the first hook 840 and second hook 850 are oriented to hold the spanning member 830 at an acute angle to the grid beams 810, 820. Likewise, the shape of spanning member 830 is skewed to accommodate the angular positioning of support bar 820.

Figure 9:
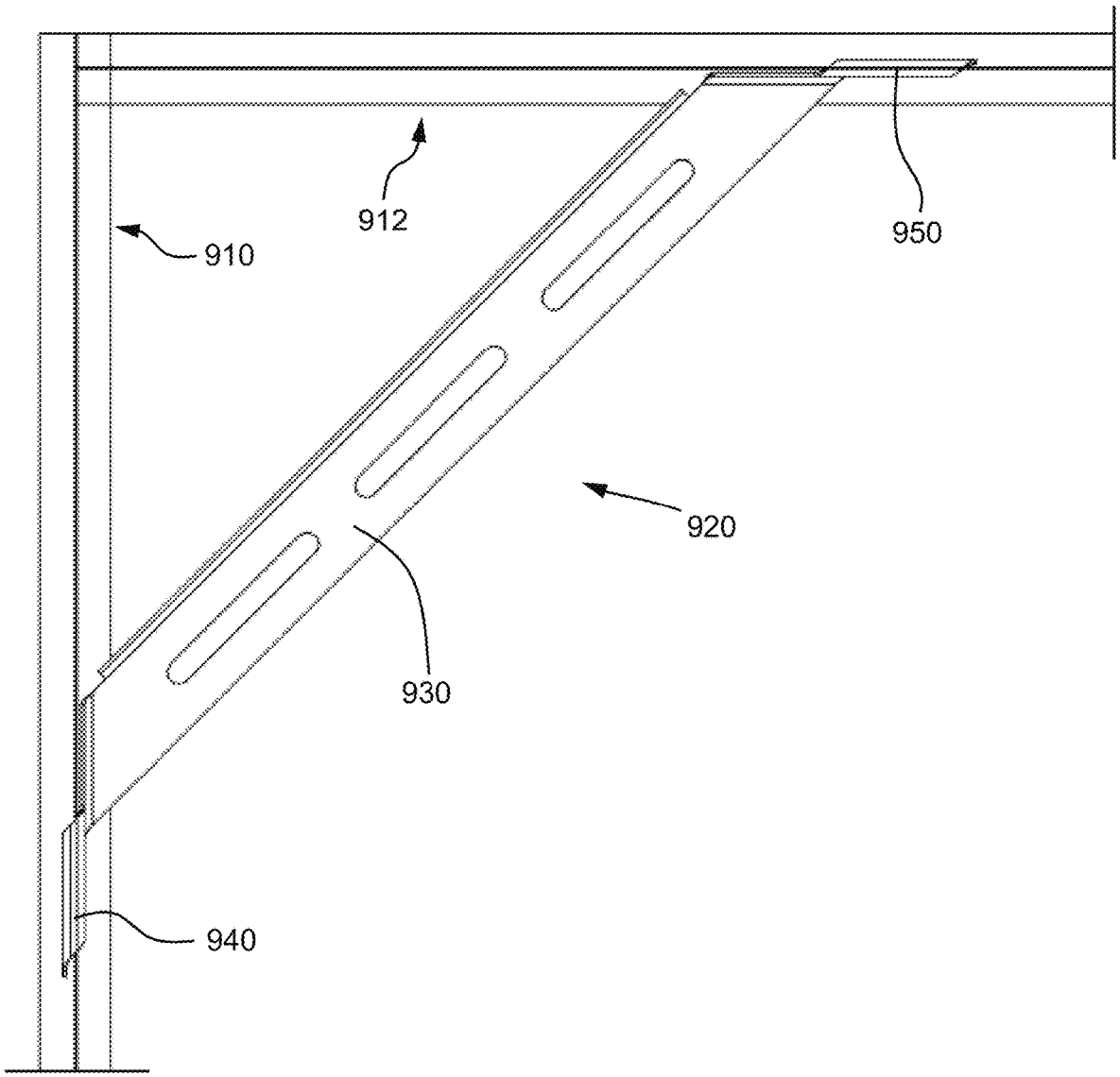
FIG. 9 is a schematic top view of a ceiling system according to yet another embodiment of the disclosure.

Similarly, FIG. 9 shows an embodiment of a support bar configured to span perpendicular grid beams. Support bar 920 includes a spanning member 930 that extends between a first hook 940 and a second hook 950. The first hook 940 and second hook 950 are arranged perpendicularly to one another such that the first hook 940 is configured to couple to a first grid beam 910 and the second hook 950 is configured to couple to a second grid beam 912 that is perpendicular to the first grid beam 910. In order to accommodate the angled position of the support bar 920, the inner side of the spanning element 930 is shorter than the outer side. In other embodiments, the support bar may be configured to span grid beams that are arranged at other angles from one another. In such embodiments, the support bar may be perpendicular to one of the grid beams and angled with respect to the other, or may be angled with respect to both grid beams.

Further, in some embodiments, the support bar is configured to span grid beams that are located at different elevations. An embodiment of such a support bar is shown in FIG.

Figure 10:
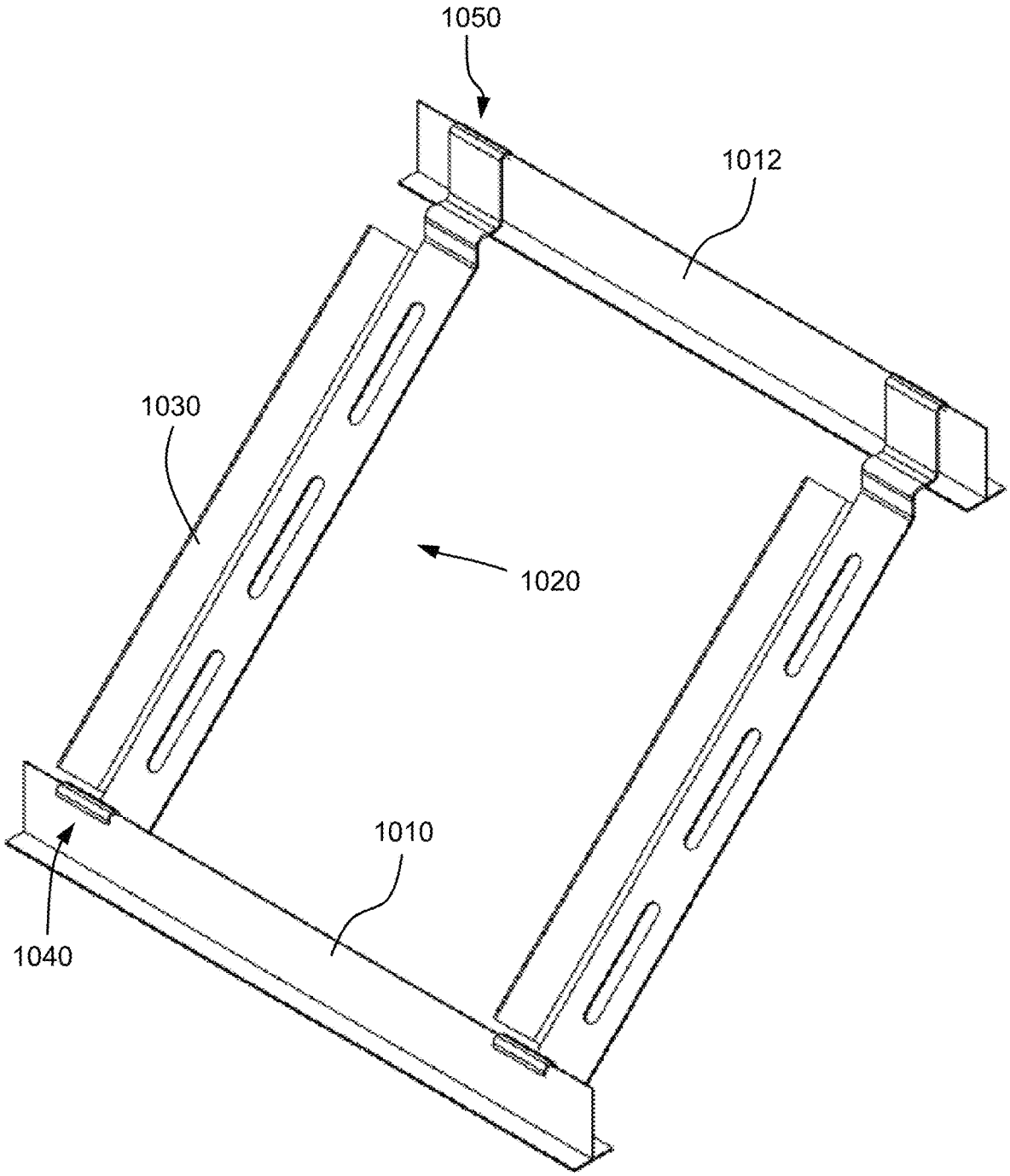
FIG. 10 is a schematic perspective view of a ceiling system according to another embodiment of the disclosure.

10. Support bar 1020 includes a spanning member 1030, a first hook 1040, and a second hook 1050. Each of the hooks 1040, 1050 is tilted in the same direction with respect to the spanning member 1030. Accordingly, the spanning member 1030 can extend at an angle between grid members with the same rotation but positioned at different elevations. For example, first grid beam 1010 and second grid beam 1012, shown in FIG. 10, are both rotated in a standard inverted T-grid orientation, with the web facing upward. However, second grid beam 1012 is offset from and positioned above first grid beam 1010. The support bar 1020 is configured so that the first hook 1040 secures to the first grid beam 1010, the second hook 1050 secures to the second grind beam 1012, and the spanning member extends upward at an angle from the first grid beam 1010 to the second grid beam 1012.

In some embodiments, the support bar is disposed at an angle to the grid beams and also spans grid beams disposed at different elevations. For example, in some embodiments, from a top view, the spanning member may be positioned at an angle to the grid beams similar to the embodiment shown in FIG. 8, but the grid beams may be positioned at different elevations. Likewise, in some embodiments, the support bar may span grid beams that are angled with respect to one another and that are also disposed at different elevations.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

EMBODIMENTS

Embodiment 1. A support bar configured to extend across grid beams of a ceiling grid, the support bar comprising:

a first hook configured to secure to a first grid beam of the ceiling grid;

a second hook configured to secure to a second grid beam of the ceiling grid; and a spanning member extending from the first hook to the second hook and configured to support the weight of an element attached to the support bar.

Embodiment 2. The support bar according to embodiment 1, wherein the first hook is disposed at a first end of the support bar and the second hook is disposed at a second end of the support bar.

Embodiment 3. The support bar according to embodiment 1 or embodiment 2, wherein the spanning member includes a base plate.

Embodiment 4. The support bar according to embodiment 3, wherein the first hook is configured as a bent plate that extends from the base plate of the spanning member.

Embodiment 5. The support bar according to embodiment 4, the width of the first hook is the same as the width of the base plate.

Embodiment 6. The support bar according to any of embodiments 3 to 5, wherein the first hook includes a leg projecting upward from the base plate and a bend configured to extend over the first grid beam.

Embodiment 7. The support bar according to embodiment 6, wherein a width of the bend of the first hook is no more than half the width of the base plate.

Embodiment 8. The support bar according to embodiment 7, wherein the bend of the first hook is positioned entirely on a first side of a centerline that extends along a length of the base plate.

Embodiment 9. The support bar according to embodiment 8, wherein the second hook includes a leg projecting upward from the base plate and a bend configured to extend over the second grid beam, and wherein the bend of the second hook is positioned entirely on a second side of the centerline.

Embodiment 10. The support bar according to any of embodiments 6 to 9, wherein the leg extends substantially vertically from the base plate.

Embodiment 11. The support bar according to any of embodiments 6 to 9, wherein the leg extends at an angle from the base plate to the bend.

Embodiment 12. The support bar according to any of embodiments 6 to 11, wherein the first hook includes a downward extension projecting downward from the bend such that the hook is configured to surround a portion of the first grid beam.

Embodiment 13. The support bar according to any of embodiments 1 to 12, wherein the first hook includes an aperture configured to receive a fastener for securing the first hook to the first grid beam.

Embodiment 14. The support bar according to any of embodiments 3 to 13, wherein the base plate is configured as a flange and the spanning member further comprises a web extending upward from the base plate.

Embodiment 15. The support bar according to embodiment 14, wherein the web includes an aperture.

Embodiment 16. The support bar according to any of embodiments 1 to 15, wherein the spanning member includes a plurality of apertures along the length thereof.

Embodiment 17. The support bar according to embodiment 16, wherein the apertures are slots that extend in the length direction of the spanning member.

Embodiment 18. The support bar according to any of embodiments 1 to 17, wherein the support bar includes an aperture that extends from the spanning member into the hook.

Embodiment 19. The support bar according to any of embodiments 1 to 18, wherein a height of the first hook is configured to be substantially the same as a height of the first grid beam.

Embodiment 20. The support bar according to any of embodiments 1 to 18, wherein a height of the first hook is configured to be greater than a height of the first grid beam.

Embodiment 21. The support bar according to any of embodiments 1 to 20, wherein the support bar is formed from a cut and bent metal strip.

Embodiment 22. The support bar according to any of embodiments 1 to 21, wherein a length of the support bar from the first hook to the second hook is about 12 inches, or about 24 inches, or about 48 inches.

Embodiment 23. The support bar according to any of embodiments 1 to 22, wherein a width of the support bar is at least 1 inch, e.g., at least 1.5 inches, e.g., at least 2 inches.

Embodiment 24. The support bar according to any of embodiments 1 to 23, wherein a width of the support bar is no more than 8 inches, e.g., no more than 6 inches, e.g., no more than 4 inches.

Embodiment 25. A ceiling system comprising:

a ceiling grid including a plurality of grid beams comprising a first grid beam and a second grid beam that is parallel to the first grid beam; and a support bar according to any of embodiments 1 to 24 extending from the first grid beam to the second grid beam, wherein the first hook of the support bar is secured to the first grid member and the second hook of the support bar is secured to the second grid member.

Embodiment 26. The ceiling system according to embodiment 25, wherein the grid beams are T-beams.

Embodiment 27. The ceiling system according to embodiment 25 or embodiment 26, wherein the spanning member includes a base plate.

Embodiment 28. The ceiling system according to embodiment 27, wherein the first hook includes a leg projecting upward from the base plate and a bend extending over the first grid beam.

Embodiment 29. The ceiling system according to embodiment 28, wherein the first hook includes a downward extension projecting downward from the bend such that the hook surrounds a portion of the first grid beam.

Embodiment 30. The ceiling system according to any of embodiments 25 to 29, wherein the first hook includes an aperture, and wherein a mechanical fastener extends through the aperture in the first hook and secures the first hook to the first grid beam.

Embodiment 31. The ceiling system according to any of embodiments 25 to 30, wherein the spanning member includes a plurality of apertures along the length thereof.

Embodiment 32. The ceiling system according to embodiment 31, wherein an element is secured to the support bar using a mechanical fastener that extends through one of the apertures.

Embodiment 33. The ceiling system according to embodiment 31, wherein an element is secured to the support bar using a torsion spring that extends through one of the apertures.

Embodiment 34. The ceiling system according to embodiment 31, wherein an element is secured to the support bar using a clip that engages the support bar.

Embodiment 35. The ceiling system according to any of embodiments 25 to 34, wherein a height of the first hook is substantially the same as a height of the first grid beam.

Embodiment 36. The ceiling system according to any of embodiments 25 to 35, wherein a lower surface of the spanning member is substantially aligned with a surface defined by the ceiling grid.

Embodiment 37. The ceiling system according to any of embodiments 25 to 36, wherein a height of the first hook is greater than a height of the first grid beam.

Embodiment 38. The ceiling system according to any of embodiments 25 to 37, wherein a first end of the spanning member is supported by the first grid beam and a second end of the spanning member is supported by the second grid beam.

Embodiment 39. A ceiling system comprising:

a ceiling grid including a plurality of grid beams comprising a first grid beam and a second grid beam that is parallel to the first grid beam;

a support bar according to any of embodiments 1 to 24 extending from the first grid beam to the second grid beam, wherein the first hook of the support bar is secured to the first grid member and the second hook of the support bar is secured to the second grid member; and an access ceiling panel coupled to the spanning member of the support bar using a mechanical fastener.

Embodiment 40. The ceiling system according to embodiment 39, wherein the plurality of grid beams further comprises transverse beams that extend from the first grid beam to the second grid beam so as to form openings in the ceiling grid.

Embodiment 41. The ceiling system according to embodiment 40, wherein the access ceiling panel is sized to fit in a single opening of the ceiling grid.

Embodiment 42. The ceiling system according to embodiment 40, wherein the access ceiling panel extends over a transverse beam so as to overlap more than one opening.

Embodiment 43. The ceiling system according to any of embodiments 39 to 42, further comprising an additional support bar extending form the first grid beam to the second grid beam, wherein the access ceiling panel is coupled to the additional support bar.

Embodiment 44. The ceiling system according to any of embodiments 39 to 43, wherein the access ceiling panel is not mechanically fastened to the grid beams of the ceiling grid.

Embodiment 45. The ceiling system according to any of embodiments 39 to 44, further comprising a fixed ceiling panel coupled to the grid beams.

What is claimed is:

1. A ceiling system comprising:

a ceiling grid including a plurality of grid beams comprising a first grid beam and a second grid beam that is parallel to the first grid beam; and a support bar extending between the first and second grid beams of the ceiling grid, the support bar comprising:

a first hook disposed at a first end of the support bar and secured to the first grid beam of the ceiling grid, the first hook including a leg extending upwards from the base plate of the spanning member and a bend extending over the first grid beam, the first grid beam of the ceiling system supporting the first hook;

a second hook disposed at a second end of the support bar and secured to the second grid beam of the ceiling grid, the second hook including a leg extending upwards from the base plate of the spanning member and a bend extending over the second grid beam, the second grid beam of the ceiling system supporting the second hook; and a spanning member extending from the first hook to the second hook, the spanning member comprising a base plate configured as a horizontally-extending flange, and a web extending upward from the base plate, wherein the base plate, the web, the first hook and the second hook are formed by a single piece of material that is bent at ends thereof to from the first hook and the second hook and bent along a side thereof to form the web; and an element attached to the spanning member, the weight of the element being supported by the spanning member.

2. The ceiling system according to claim 1, wherein in each of the first hook and the second hook the leg extends substantially vertically from the base plate.

3. The ceiling system according to claim 1, wherein the first hook includes an aperture, and wherein a mechanical fastener extends through the aperture in the first hook and secures the first hook to the first grid beam.

4. The ceiling system according to claim 1, wherein the spanning member includes a plurality of apertures along the length thereof, and wherein the element is secured to the spanning member using a mechanical fastener that extends through one of the apertures.

5. The ceiling system according to claim 1, wherein the spanning member includes a plurality of apertures along the length thereof, and wherein the element is secured to the spanning member using a torsion spring that extends through one of the apertures.

6. The ceiling system according to claim 1, wherein the element is secured to the spanning member using a clip that engages the spanning member.

7. The ceiling system according to claim 1, wherein a height of the first hook is greater than a height of the first grid beam.

8. The ceiling system according to claim 1, wherein the element is an access ceiling panel coupled to the spanning member of the support bar using a mechanical fastener.

9. The ceiling system according to claim 1, wherein the element is not mechanically fastened to the grid beams of the ceiling grid.

10. The ceiling system according to claim 1, wherein the first hook includes a bend configured extending over and resting on the first grid beam, and the second hook includes a bend configured extending over and resting on the second grid beam.

11. The ceiling system according to claim 1, wherein the first grid beam is a T-beam comprising an upper bulb on which the bend of the first hook of the support bar rests, and the second grid beam is a T-beam comprising an upper bulb on which the bend of the second hook of the support bar rests.

12. The ceiling system according to claim 1, wherein the element is a light, ventilation equipment, electrical equipment or network equipment.

13. The ceiling system of claim 1, wherein the element is attached to a bottom surface of the base plate of the spanning member.

* * * * *